US006606758B1

(12) United States Patent
Fridman

(10) Patent No.: US 6,606,758 B1
(45) Date of Patent: Aug. 19, 2003

(54) SERRATED HAND TOOL FOR PLASTER APPLICATION OVER A SURFACE JOINT

(76) Inventor: Emilian Fridman, 37 Clara St., 2nd floor, Brooklyn, NY (US) 11218

( * ) Notice: Subject to any disclaimer, the term of this patent is extended or adjusted under 35 U.S.C. 154(b) by 433 days.

(21) Appl. No.: 09/695,654

(22) Filed: Oct. 25, 2000

Related U.S. Application Data

(63) Continuation-in-part of application No. 09/350,347, filed on Jul. 14, 1999, now Pat. No. 6,167,585.

(51) Int. Cl.[7] ..... B05C 17/10

(52) U.S. Cl. ..... 15/245.1; 15/235.6; 15/236.08; D8/45

(58) Field of Search ..... 15/235.4, 235.6, 15/236.01, 236.02, 236.06, 236.08, 245.1; 425/458; D8/45; D32/46, 49

(56) References Cited

U.S. PATENT DOCUMENTS

| | | | | |
|---|---|---|---|---|
| 711,423 A | | 10/1902 | Greene | 119/631 |
| 1,930,977 A | | 10/1933 | Kirch | 119/617 |
| 1,961,531 A | | 6/1934 | Seek | 30/125 |
| 2,934,936 A | * | 5/1960 | Vernon | 15/235.4 |
| 4,064,588 A | | 12/1977 | Cooper | 15/236.08 |
| 4,316,302 A | | 2/1982 | Clark | 15/235.4 |
| 4,497,114 A | | 2/1985 | Belcher | 33/41.4 |
| 4,804,321 A | | 2/1989 | Riesgo | 425/87 |
| 5,231,729 A | | 8/1993 | Rose | 15/235.4 |
| 5,524,316 A | | 6/1996 | Johnson | 15/210.5 |
| 5,607,256 A | | 3/1997 | McCleary | 404/105 |
| 5,723,185 A | | 3/1998 | Beier | 427/429 |
| 5,778,482 A | | 7/1998 | Sbirato | 15/245.1 |

* cited by examiner

*Primary Examiner*—Mark Spisich
(74) *Attorney, Agent, or Firm*—Boris Leschinsky

(57) ABSTRACT

A method and a serrated hand tool for construction are disclosed. A novel hand tool for plaster application over a taped surface joined includes a blade having a central section and two serrated side sections. The central section contains a cutout with a straight edge of sufficient width to allow a thicker layer of plaster to be placed over the tape. The serrated side sections contain a number of teeth with a triangular shape. According to the method, the plaster is applied in a plurality of parallel lines under the side sections and in a smooth straight layer under the central section of the tool all at one time to reduce the overall construction time, plaster consumption, and the skill level required to perform the task.

7 Claims, 1 Drawing Sheet

SERRATED HAND TOOL FOR PLASTER APPLICATION OVER A SURFACE JOINT

CROSS-REFERENCE DATA

This is a continuation-in-part of the patent application Ser. No. 09/350,347 filed Jul. 14, 1999, U.S. Pat. No. 6,167,585.

BACKGROUND OF THE INVENTION

1. Field of the Invention

The present invention relates generally to a method and a hand tool for plaster spreading and more specifically to serrated hand tools for spreading plaster and the like. In particular, the hand tool of the invention can be effectively utilized for spreading a plaster or a joint compound over a taped surface joint such as between two sections of a drywall.

2. Description of the Prior Art

Construction practice have long required a reliable method and appropriate hand tool to spread plaster and other similar type compounds such as gypsum, cement, mortar, grout, joint mixes, spackling pastes, etc. All of these and other similar compounds are described herein as "plaster" for the purposes of this specification.

For an experienced worker, spreading a plaster compound over a perfectly flat and well prepared surface does not present a challenge. It is when the surface is not flat as is encountered in most cases, when the presently known spreading methods need improvements.

In a commonly known plaster spreading technique, a hand tool or trowel with a straight edge is used to take some soft plaster from a container and apply it over the working surface trying to maintain a constant thickness of the layer of plaster. This thickness depends on the skill of the worker and the force with which the plaster is applied. However, when the surface has bumps or valleys, maintaining the constant depth becomes quite difficult. As a result, the final surface of the hardened compound is not perfectly flat. In order to improve this technique, it is known to apply the plaster in several steps, building up the plaster layers in a gradual way. This method requires a long time to complete because every consecutive layer of plaster has to cure at least 1 to 2 hours before the next one can be applied. Typically, at least three layers of plaster are applied this way to achieve a good result. Care should also be taken not to allow cracking of the plaster compound which may occur due to excessive and uneven thickness of the plaster layer. In addition, due to natural irregularities of this plaster application method, some hardened plaster has to be periodically removed to smooth out the surface which requires more working time. Finally, that and excessive thickness of plaster also lead to a higher consumption of plaster material and hence, higher material waste.

Plaster spreading over a taped surface joint presents a separate challenge. Using a commonly known plaster spreader with a blade having a straight edge, a construction worker has to go through the following four steps:

1. A narrow spreader is used first to place a thin layer of joint compound over a drywall surface joint so a paper (for example SHEET ROCK JOINT TAPE 2116 IN×250 FT ROLL) or a plastic (for example FIBA TAPE 295S) joint tape can be placed over it to cover the area of the joint and prevent it from future separation;
2. After allowing the joint to dry, a wide spreader is used to place two thin layers of plaster over the joint area with enough time in between the coats to allow the first wide coat to dry;

3. Again allowing the two thin layers to dry completely, a sanding procedure is conducted to smooth the surface; and finally
4. The final plaster layer is then placed over the area to bring the surface up to its finished geometry.

Depending on the temperature and humidity in the room, the time needed for drying of each of the layers may vary but generally it stays in the range of between 5 to 6 hours. This process requires a lot of time, as well as a construction worker with very high level of skills to achieve a good result. A method and a device therefore are needed to reduce the total time for making the joint and to reduce the skill level of a construction worker without sacrificing the quality of the end result.

Serrated or notched trowels and hand tools are known in the prior art mostly for applying glue and tile compounds. They typically have a plurality of V-shaped or square notches along the working edge and are designed to evenly distribute the paste preparing the surface to be covered with tiles, linoleum and alike. Following examples illustrate some known serrated hand tools.

U.S. Pat. No. 2,287,231 by Cathcard is directed to a paste spreader for spreading paste, cement, glue and the like on a surface to be covered with a covering such as linoleum which evenly distributes the paste. The spreader blade is fabricated of a flexible material and is serrated along one edge.

U.S. Pat. No. 2,824,330 by Williams is directed to a spreader for cement and the like on a surface to be covered with a covering, such as Formica, which evenly spreads the cement. The spreader blade is square and is removably attached to a handle. Each of the four edges of the blade has different sized notches or serrations.

U.S. Pat. No. 3,916,472 by Carder is directed to a trowel for applying adhesives to a surface such as a floor or wall to be covered. The edges of the trowel are serrated to evenly spread the adhesive.

U.S. Pat. No. 4,316,302 by Clark is directed to an adhesive spreading trowel having all four edges either straight or serrated and is adapted for manufacture by injection molding.

U.S. Pat. No. 4,654,919 by Lieberman is directed to a spreader for applying plaster and cement to wallboard. The spreader has a spreader blade attached to a handle with a backing layer next to the blade to add rigidity to the blade. The edge of the blade extends past the edge of the backing layer. The plate is made of a flexible material such as plastic and has a straight edge as opposed to a serrated edge.

U.S. Pat. No. 4,804,321 by Riesgo is directed to a cement spreader with a blade having a plurality of squared notches.

U.S. Pat. No. 5,231,729 by Rose is directed to a tilers trowel having square notches and adjustment means for limiting the depth-of material which can be applied.

U.S. Pat. No. 5,524,316 by Johnson is directed to a hand tool for spreading plaster on a substrate such as a ceiling and alike in decorative patterns. The tool has stiff but resilient serrated blade and a handle attached to the blade at an opposite or proximal edge from a serrated distal edge. Tool alignment marks are also provided to aid in decorative application of the plaster compound.

Finally, U.S. Pat. No. 5,778,482 by Sbrigato is directed to a serrated spreader for a cold-coat of roofing tar. It contains a hard rubber blade with serrations, which, when pushed over the surface to be roofed, spreads the desired coat of tar over a predetermined width of the surface to be roofed.

These and other known devices of the prior art fail to address the main problem of the plaster spreading work, namely allow for a quick to apply method of accurate plaster spreading over an imperfect surface without the need for multiple repetitive applications of plaster. Therefore, the need exists for a method and a hand tool to allow for such improvement in the plaster application technique and especially over a joint surface. In addition, the need exists for a plaster application method and a hand tool allowing for lower level of skill required to achieve smooth final surface, reducing the drying time between the layers, reducing the tendency of plaster to form cracks, and reducing the plaster material waste.

SUMMARY OF THE INVENTION

Accordingly, it is an object of the present invention to overcome these and other drawbacks of the prior art by providing a novel method and a hand tool for plaster spreading using a serrated edge principle.

It is another object of the present invention to provide a method and a hand tool for plaster spreading allowing to substantially reduce the total time required to achieve the final smooth surface joint.

It is a further object of the present invention to provide a method and a hand tool for plaster spreading allowing to achieve a final smooth surface over somewhat irregular initial surface, all with lower level of worker skills.

Finally, it is another object of the invention to provide a method and a hand tool allowing plaster spreading with minimum waste of plaster material.

The basics of the serrated edge design and its use for plaster application were described in detail in the previous co-pending patent application. According to the method of the instant invention, a commonly known serrated edge principle is used in a novel way to aid in plaster spreading over a joint surface. After the surface of a joint is initially prepared to eliminate larger defects, the first, third and fourth steps of a novel method are the same as was described above. It is the second step and the use of a novel tool which is different and allows for the above mentioned objectives.

The tool of the present invention has a flexible metal blade equipped with a handle. The blade edge has three sections: the first and the third side sections are equipped with serrated teeth in a similar way as was described in the previous patent application. The second or central section has a cutout which is designed to allow a thicker layer of plaster to be placed over a tape of a surface joint.

According to a method of the invention, the second step in the operation of applying plaster is done using a hand tool of the invention in such a way that in one step a thicker layer of plaster is placed over the tape, while two thin serrated layers of plaster are placed on both sides of the tape. Once dry, only the finishing layer of plaster needs to be applied on top of the layer placed in the second step.

For a better understanding of the invention, its operating advantages and the specific objects attained by its uses, reference should be made to the accompanying drawings and descriptive matter in which there is illustrated a preferred embodiment of the present invention.

BRIEF DESCRIPTION OF THE DRAWINGS

A more complete appreciation of the subject matter of the present invention and the various advantages thereof can be realized by reference to the following detailed description in which reference is made to the accompanying drawing in which.

DETAILED DESCRIPTION OF THE FIRST AND MOST PREFERRED EMBODIMENT OF THE INVENTION

Figures 1, 2:
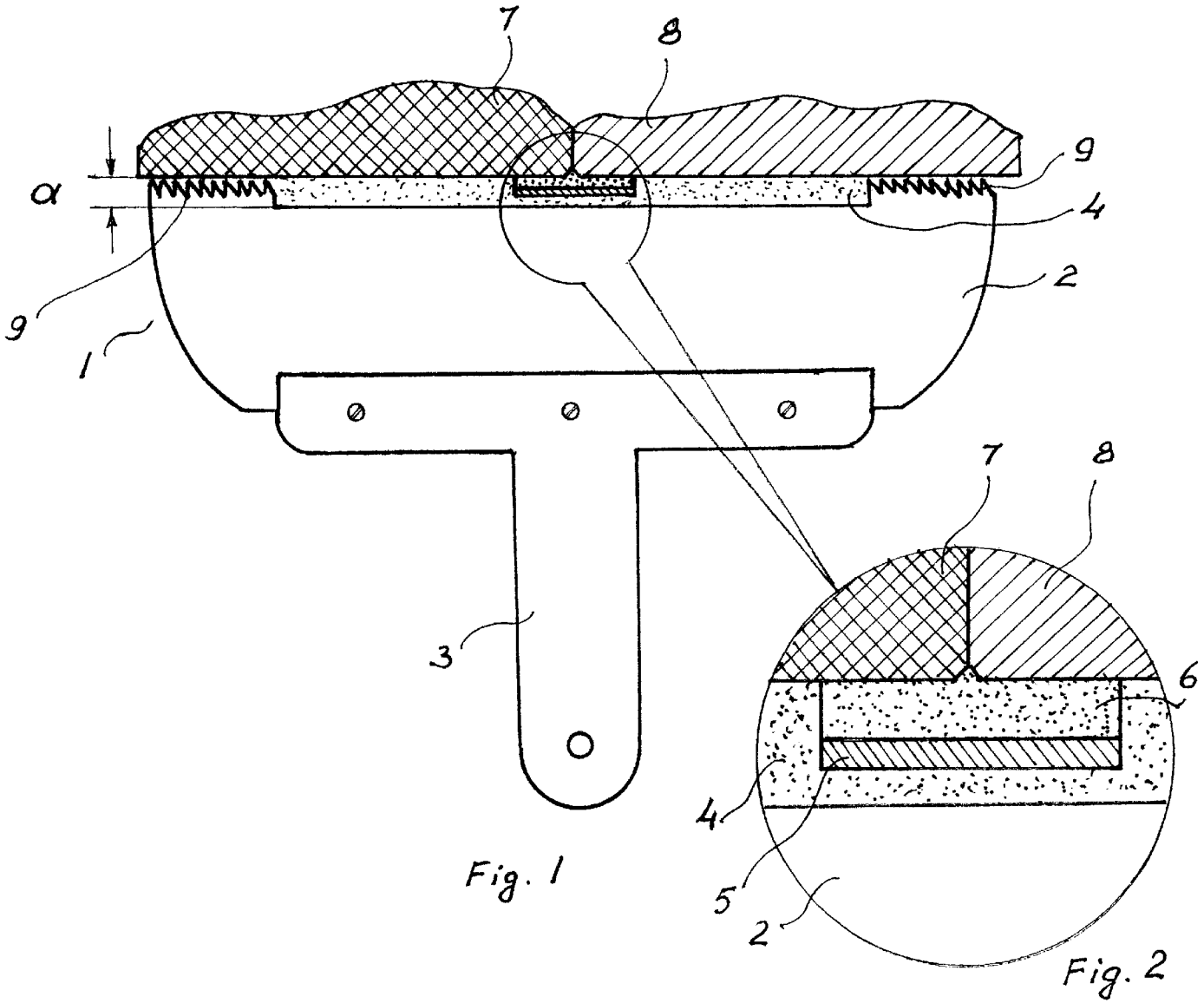
FIG. 1 is a view of a hand tool according to the present invention.
FIG. 2 is an enlarged section of the tool and the surface joint showing the details of the central section of the blade.

A detailed description of the first embodiment of the present invention follows with reference to accompanying drawings in which like elements are indicated by like reference numerals.

FIG. 1 illustrates a view of the hand tool (1) of the invention containing a metal blade (2) with a handle (3). The edge of the blade (2) located opposite the handle (3) consists of three sections: two serrated-side sections (9) and a central section (4). Serrated sections (9) have a plurality of teeth of generally triangular shape. One particular example of the triangular shape was described in detail in the previous patent application. Briefly stating, each of the side sections (9) has a plurality of teeth placed along the length of each section (9). Each tooth is of generally triangular shape. Our evaluation indicates that although many shapes of teeth and notches would produce acceptable results in use, one example of the good utility of the tool can be achieved by making the triangular tooth in the following way: one side of the triangle is perpendicular to the direction of the blade edge (9) while the other side forms a certain angle with the blade edge (9). For good results, the value of that angle is designed to be between about 35 and about 45 degrees. The depth of each tooth is preferably chosen to be between about 1/16 and about 1/8 of an inch. Another important detail of the shape of each tooth is in its upper portion, namely the presence of a smooth oval shape transition from one tooth to the next. The purpose of this transition is to eliminate the sharp upper edge of the plaster line when the tool is used. Sharp line of plaster is easily cracked while the oval blunt shape of the plaster line leads to a reliable and hard to crack upper edge. Another reason to avoid sharp angle between the teeth is to prevent irregular filling of it with viscous plaster paste. Due to high viscosity, the plaster paste fills the oval shape much better and more consistently.

A further important detail of the tooth design described in the previous patent application is the shape of the lower end of the tooth. According to the invention, each tooth has a blunt and generally flat lower end allowing for a smooth gliding of the hand tool (1) along the surface of a joint.

The central section (4) of the blade (2) contains a cutout with a straight innermost edge the length of which is at least as long as the width of the tape (5) but preferably about 3–4 times longer than that making it about 5–8 inches long. This innermost edge of the cutout of the central section (4) is generally parallel to the edge of the blade (2). FIG. 1 shows the tape (5) placed over the layer of joint compound (6) filling the space between the drywall section (7) and drywall section (8). The depth of the cutout (a) is determined as a distance between its innermost edge and the outer line of the teeth of a side section (9) and should be sufficient to cover the tape (5) with enough plaster. It is preferred to make that depth about 1/4 of an inch.

According to the method of the invention, the step of applying plaster over a surface joint is best done using the hand tool (1) described above. Taking some plaster paste material from the plaster container on the edge of the blade (2), the construction worker can spread that plaster along the substrate surface joint forming an offset layer of plaster over the tape (5) and separately two side sections of serrated plaster lines of generally triangular shape and equal height as shown on FIG. 1. Due to limited height and space between the plaster lines caused by the presence of teeth with flat edges, it takes only a short time, typically about 20 to 30 minutes for the plaster lines to dry and harden. It is also important to point out that a plurality of upper edges of these plaster lines are formed all in one general plane which is helpful at the next step of the plaster spreading sequence. Additionally, due to their limited thickness, plaster lines do not crack as easily as a solid layer of plaster of variable thickness.

At that point, there is no need for a further layer of plaster. Rather, after allowing the previous layer to dry, a worker can proceed through to the third and fourth steps as described above.

DETAILED DESCRIPTION OF THE SECOND MOST PREFERRED EMBODIMENT OF THE INVENTION

According to the second embodiment of the invention (not shown on the drawings), the central section of the hand tool is also equipped with the plurality of teeth in a way similar to the two side sections. That gives the same benefits in the middle of the surface joint as on its sides when the tool is used. The shape of the teeth in the central cut-out section may be of any triangular shape but is preferred to be the same as on the side sections which was described in detail above. The use of the tool is the same as for the first embodiment of the invention except the central offset layer will have a plurality of triangular lines of plaster, similar to that produced by the side sections of the tool.

The above described method and a novel hand tool allow for several important advantages:

- the time needed for finishing the entire job is significantly reduced;
- the quality and repeatability of the surface joint finish is higher than with the use of a standard hand tool;
- the required skill level of a worker is not as high.

Although the present invention has been described with respect to a specific embodiment and application, it is not limited thereto. For example, instead of using the tool and the method over a surface joint, one can also use it to smooth over an irregular section of a wall. Numerous variations and modifications will be readily appreciated by those skilled in the art and are intended to be included within the scope of the present invention, which is recited in the following claims.

What I claim is:

1. A serrated hand tool for applying a plaster compound over a surface joint, said tool comprising:

a blade with a blade edge having a central section and two serrated side sections on opposite sides of said central section, said serrated side sections having a plurality of teeth, each tooth being of a generally triangular shape, said central section having a cutout with an innermost edge, said innermost edge being spaced from and generally parallel to the side sections, and a handle attached to said blade.

2. A serrated hand tool as in claim 1, wherein said triangular shape defined by a first side of the tooth and a second side of the tooth, said first side being perpendicular to said blade edge and said second side forming an acute angle with said blade edge of about 35 to 45 degrees.

3. A serrated hand tool as in claim 1, wherein said central section is about 5–8 inches long.

4. A serrated hand tool as in claim 1, wherein a depth of said innermost edge is about ¼ of an inch.

5. A serrated hand tool as in claim 1, wherein said innermost edge is straight.

6. A serrated hand tool as in claim 1, wherein said innermost edge is serrated with a plurality of teeth, each tooth being of generally triangular shape.

7. A serrated hand tool as in claim 6, wherein the shape of the teeth of the innermost edge is the same as the shape of the teeth of the two serrated side sections.

* * * * *